US007343115B2

(12) United States Patent
Oka

(10) Patent No.: US 7,343,115 B2
(45) Date of Patent: Mar. 11, 2008

(54) IMAGE FORMING APPARATUS AND SETTING METHOD

(75) Inventor: Yuya Oka, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 45 days.

(21) Appl. No.: 11/223,271

(22) Filed: Sep. 9, 2005

(65) Prior Publication Data

US 2007/0059014 A1 Mar. 15, 2007

(51) Int. Cl.
*G03G 15/00* (2006.01)

(52) U.S. Cl. ..... 399/83; 399/82

(58) Field of Classification Search ..... 399/83
See application file for complete search history.

(56) References Cited

U.S. PATENT DOCUMENTS

| | | | | |
|---|---|---|---|---|
| 7,076,673 | B2 * | 7/2006 | Yoshikawa | 713/300 |
| 2002/0015599 | A1 * | 2/2002 | Takuwa et al. | 399/82 |
| 2006/0133829 | A1 * | 6/2006 | Kato | 399/8 |

FOREIGN PATENT DOCUMENTS

| | | |
|---|---|---|
| JP | 7-183978 | 7/1995 |
| JP | 2002-77478 | 8/2000 |
| JP | 2004-54267 | 6/2003 |
| JP | 2005-103868 | 4/2005 |

OTHER PUBLICATIONS

Machine Translation JP 2004-054267, Tanaka et al., Feb. 19, 2004.*
Chinese Patent Office Action, Application No. 200610126931.1 by Toshiba TEC, Office Action dated Oct. 19, 2007.

* cited by examiner

*Primary Examiner*—David M. Gray
*Assistant Examiner*—David A Blackshire
(74) *Attorney, Agent, or Firm*—SoCal IP Law Group LLP

(57) ABSTRACT

In an image forming apparatus, a controller acquires data such as operation start time and operation end time of the image forming apparatus, and records it in an acquisition database. The controller fetches data recorded in the acquisition database to calculate a frequency of use. The controller creates each transition time of auto power saving, auto off, auto clear and weekly timer, and thereafter, records it in a setting database. The controller fetches data recorded in the setting database to set each transition time of the image forming apparatus.

20 Claims, 10 Drawing Sheets

FIG. 8

| Time \ Day of the week | Sunday | Monday | Tuesday | Wednesday | Thursday | Friday | Saturday |
|---|---|---|---|---|---|---|---|
| Operation start | Sun.S [1]<br>⋮<br>Sun.S [n] | Mon.S [1]<br>⋮<br>Mon.S [n] | Tue.S [1]<br>⋮<br>Tue.S [n] | Wed.S [1]<br>⋮<br>Wed.S [n] | Thu.S [1]<br>⋮<br>Thu.S [n] | Fri.S [1]<br>⋮<br>Fri..S [n] | Sat.S [1]<br>⋮<br>Sat.S [n] |
| Operation end | Sun.E [1]<br>⋮<br>Sun.E [n] | Mon.E [1]<br>⋮<br>Mon.E [n] | Tue.E [1]<br>⋮<br>Tue.E [n] | Wed.E [1]<br>⋮<br>Wed.E [n] | Thu.E [1]<br>⋮<br>Thu.E [n] | Fri..E [1]<br>⋮<br>Fri...E [n] | Sat.E [1]<br>⋮<br>Sat.E [n] |

FIG. 10

| Time zone \ Day of the week | Sunday | Monday | Tuesday | Wednesday | Thursday | Friday | Saturday |
|---|---|---|---|---|---|---|---|
| 9~12 | Sun.TU [1]<br>Sun.TI [1] | Mon.TU [1]<br>Mon.TI [1] | Tue.TU [1]<br>Tue.TI [1] | Wed.TU [1]<br>Wed.TI [1] | Thu.TU [1]<br>Thu.TI [1] | Fri.TU [1]<br>Fri..TI [1] | Sat.TU [1]<br>Sat.TI [1] |
| 12~15 | Sun.TU [2]<br>Sun.TI [2] | Mon.TU [2]<br>Mon.TI [2] | Tue.TU [2]<br>Tue.TI [2] | Wed.TU [2]<br>Wed.TI [2] | Thu.TU [2]<br>Thu.TI [2] | Fri.TU [2]<br>Fri..TI [2] | Sat.TU [2]<br>Sat.TI [2] |
| 15~18 | Sun.TU [3]<br>Sun.TI [3] | Mon.TU [3]<br>Mon.TI [3] | Tue.TU [3]<br>Tue.TI [3] | Wed.TU [3]<br>Wed.TI [3] | Thu.TU [3]<br>Thu.TI [3] | Fri.TU [3]<br>Fri..TI [3] | Sat.TU [3]<br>Sat.TI [3] |
| 18~21 | Sun.TU [4]<br>Sun.TI [4] | Mon.TU [4]<br>Mon.TI [4] | Tue.TU [4]<br>Tue.TI [4] | Wed.TU [4]<br>Wed.TI [4] | Thu.TU [4]<br>Thu.TI [4] | Fri.TU [4]<br>Fri..TI [4] | Sat.TU [4]<br>Sat.TI [4] |
| 21~24 | Sun.TU [5]<br>Sun.TI [5] | Mon.TU [5]<br>Mon.TI [5] | Tue.TU [5]<br>Tue.TI [5] | Wed.TU [5]<br>Wed.TI [5] | Thu.TU [5]<br>Thu.TI [5] | Fri.TU [5]<br>Fri..TI [5] | Sat.TU [5]<br>Sat.TI [5] |
| 24~3 | Sun.TU [6]<br>Sun.TI [6] | Mon.TU [6]<br>Mon.TI [6] | Tue.TU [6]<br>Tue.TI [6] | Wed.TU [6]<br>Wed.TI [6] | Thu.TU [6]<br>Thu.TI [6] | Fri.TU [6]<br>Fri..TI [6] | Sat.TU [6]<br>Sat.TI [6] |
| 3~6 | Sun.TU [7]<br>Sun.TI [7] | Mon.TU [7]<br>Mon.TI [7] | Tue.TU [7]<br>Tue.TI [7] | Wed.TU [7]<br>Wed.TI [7] | Thu.TU [7]<br>Thu.TI [7] | Fri.TU [7]<br>Fri..TI [7] | Sat.TU [7]<br>Sat.TI [7] |
| 6~9 | Sun.TU [8]<br>Sun.TI [8] | Mon.TU [8]<br>Mon.TI [8] | Tue.TU [8]<br>Tue.TI [8] | Wed.TU [8]<br>Wed.TI [8] | Thu.TU [8]<br>Thu.TI [8] | Fri.TU [8]<br>Fri..TI [8] | Sat.TU [8]<br>Sat.TI [8] |

| Time \ Day of the week | Sunday | Monday | Tuesday | Wednesday | Thursday | Friday | Saturday |
|---|---|---|---|---|---|---|---|
| in | Sun.I | Mon.I | Tue.I | Wed.I | Thu.I | Fri.I | Sat.I |
| out | Sun.O | Mon.O | Tue.O | Wed.O | Thu.O | Fri.O | Sat.O |

FIG. 11

| Time zone \ Day of the week | Sunday | Monday | Tuesday | Wednesday | Thursday | Friday | Saturday |
|---|---|---|---|---|---|---|---|
| 9~12 | Sun.A [1] | Mon.A [1] | Tue.A [1] | Wed.A [1] | Thu.A[1] | Fri.A [1] | Sat.A [1] |
| 12~15 | Sun.A [2] | Mon.A [2] | Tue.A [2] | Wed.A [2] | Thu.A[2] | Fri.A [2] | Sat.A [2] |
| 15~18 | Sun.A [3] | Mon.A [3] | Tue.A [3] | Wed.A [3] | Thu.A[3] | Fri.A [3] | Sat.A [3] |
| 18~21 | Sun.A [4] | Mon.A [4] | Tue.A [4] | Wed.A [4] | Thu.A[4] | Fri.A [4] | Sat.A [4] |
| 21~24 | Sun.A [5] | Mon.A [5] | Tue.A [5] | Wed.A [5] | Thu.A[5] | Fri.A [5] | Sat.A [5] |
| 24~3 | Sun.A [6] | Mon.A [6] | Tue.A [6] | Wed.A [6] | Thu.A[6] | Fri.A [6] | Sat.A [6] |
| 3~6 | Sun.A [7] | Mon.A [7] | Tue.A [7] | Wed.A [7] | Thu.A[7] | Fri.A [7] | Sat.A [7] |
| 6~9 | Sun.A [8] | Mon.A [8] | Tue.A [8] | Wed.A [8] | Thu.A[8] | Fri.A [8] | Sat.A [8] |

FIG. 12

| Setting mode / Time zone (for each day of the week) | 1.Auto clear (Transition time) | 2.Auto power saving (Transition time) | 3.Auto off (Transition time) | 4.Weekly timer (on / off time) |
|---|---|---|---|---|
| 9~12 | Sunday : 1.Sun.S [1]<br>\|<br>Saturday : 1.Sat.S [1] | Sunday : 2.Sun.S [1]<br>\|<br>Saturday : 2.Sat.S [1] | Sunday : 3.Sun.S [1]<br>\|<br>Saturday : 3.Sat.S [1] | Sunday(ON) :<br>4.Sun.S [9]<br>Sunday(OFF) :<br>4.Sun.S [10]<br>Monday(ON) :<br>4.Mon.S [9]<br>Monday(OFF) :<br>4.Mon.S [10]<br>Tuesday(ON) :<br>4.Tue.S [9]<br>Tuesday(OFF) :<br>4.Tue.S [10]<br>Wednesday(ON) :<br>4.Wed.S [9]<br>Wednesday(OFF) :<br>4.Wed.S [10]<br>Thursday(ON) :<br>4.Thu.S [9]<br>Thursday(OFF) :<br>4.Thu.S [10]<br>Friday(ON) :<br>4.Fri.S [9]<br>Friday(OFF) :<br>4.Fri.S [10]<br>Saturday(ON) :<br>4.Sat.S [9]<br>Saturday(OFF) :<br>4.Sat.S [10] |
| 12~15 | Sunday : 1.Sun.S [2]<br>\|<br>Saturday : 1.Sat.S [2] | Sunday : 2.Sun.S [2]<br>\|<br>Saturday : 2.Sat.S [2] | Sunday : 3.Sun.S [2]<br>\|<br>Saturday : 3.Sat.S [2] | |
| 15~18 | Sunday : 1.Sun.S [3]<br>\|<br>Saturday : 1.Sat.S [3] | Sunday : 2.Sun.S [3]<br>\|<br>Saturday : 2.Sat.S [3] | Sunday : 3.Sun.S [3]<br>\|<br>Saturday : 3.Sat.S [3] | |
| 18~21 | Sunday : 1.Sun.S [4]<br>\|<br>Saturday : 1.Sat.S [4] | Sunday : 2.Sun.S [4]<br>\|<br>Saturday : 2.Sat.S [4] | Sunday : 3.Sun.S [4]<br>\|<br>Saturday : 3.Sat.S [4] | |
| 21~24 | Sunday : 1.Sun.S [5]<br>\|<br>Saturday : 1.Sat.S [5] | Sunday : 2.Sun.S [5]<br>\|<br>Saturday : 2.Sat.S [5] | Sunday : 3.Sun.S [5]<br>\|<br>Saturday : 3.Sat.S [5] | |
| 24~3 | Sunday : 1.Sun.S [6]<br>\|<br>Saturday : 1.Sat.S [6] | Sunday : 2.Sun.S [6]<br>\|<br>Saturday : 2.Sat.S [6] | Sunday : 3.Sun.S [6]<br>\|<br>Saturday : 3.Sat.S [6] | |
| 3~6 | Sunday : 1.Sun.S [7]<br>\|<br>Saturday : 1.Sat.S [7] | Sunday : 2.Sun.S [7]<br>\|<br>Saturday : 2.Sat.S [7] | Sunday : 3.Sun.S [7]<br>\|<br>Saturday : 3.Sat.S 7] | |
| 6~9 | Sunday : 1.Sun.S [8]<br>\|<br>Saturday : 1.Sat.S [8] | Sunday : 2.Sun.S [8]<br>\|<br>Saturday : 2.Sat.S [8] | Sunday : 3.Sun.S [8]<br>\|<br>Saturday : 3.Sat.S [8] | |

FIG. 14

IMAGE FORMING APPARATUS AND SETTING METHOD

BACKGROUND OF THE INVENTION

1. Field of the Invention

The present invention relates to an image forming apparatus, which is stored with various setting modes, and reads a document image to form an image, and to a setting method.

2. Description of the Related Art

Conventionally, an image forming apparatus having the following means and unit is able to set a transition time for each time zone. One is input means for inputting a setting mode of an image forming apparatus. Another is a display unit displaying the setting mode. Another is control means having a function of changing the setting mode of the image forming apparatus into a predetermined setting mode when a predetermined time elapses after the final input operation ends.

However, if the transition time to each setting mode is set every time zone of a day, there is a problem. Specifically, it is general that the frequency of using the apparatus is different every day of the week in addition to time zone. If the transition time is intactly set every time zone, the difference of the frequency of using the apparatus must be considered every day of the week. For this reason, in the same time zone, transition time to each setting mode is relatively late with respect to the frequency of use on a day of the week having low frequency of use. As a result, wasteful power consumption increases. Conversely, transition time to each setting mode is relatively early with respect to the frequency of use on a day of the week having high frequency of use. As a result, there is a problem of disturbing user's availability.

BRIEF SUMMARY OF THE INVENTION

The object of an aspect of the present invention is to provide an image forming apparatus, which sets various setting modes to proper time in accordance with the frequency of use by user, and reduces wasteful power consumption without disturbing the use, and to a setting method.

According to an aspect of the present invention, there is provided an image forming apparatus reading an image of a document and forming an image of the read document, comprising:

a clock unit provided in the image forming apparatus, and clocking time;

a first recording unit acquiring and recording use data of the image forming apparatus;

a calculation unit fetching the use data recorded in the first recording unit, and calculating a frequency of use;

a second recording unit creating transition time of each setting mode based on the frequency of use calculated by the calculation unit, and recording it; and a controller controlling said each setting mode of the image forming apparatus according to the transition time recorded in the second recording unit.

According to an aspect of the present invention, there is provided a method of setting a setting mode of an image forming apparatus reading an image of a document and forming an image of the read document, comprising:

clocking time using clock means provided in the image forming apparatus;

acquiring and recording use data of the image forming apparatus;

fetching the recorded use data to calculate a frequency of use;

creating and recording each transition time of the setting mode based on the calculated frequency of use; and clocking and controlling each setting mode of the image forming apparatus according to the recorded transition time using the clock means.

Additional objects and advantages of an aspect of the invention will be set forth in the description which follows, and in part will be obvious from the description, or may be learned by practice of the invention. The objects and advantages of an aspect of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate preferred embodiments of the invention, and together with the general description given above and the detailed description of the embodiments given below, serve to explain the principles of the invention.

FIG. 8 is a chart showing the operation start time (S[n]) and the operation end time (E[n]) every day of the week (Sunday to Saturday);

FIG. 10 is a chart showing total use time (TU[n]) and total non-use time (TI[n]) for each day of the week and for each time zone;

FIG. 11 is a chart showing in (I) and out (O) times of the longest non-use interval;

FIG. 12 is a chart showing the frequency of use (A[n]) for each day of the week (Sunday to Saturday) and for each time zone;

FIG. 14 is a view showing a transition time data table (S[n]) for each setting mode.

DETAILED DESCRIPTION OF THE INVENTION

One embodiment of the present invention will be described below with reference to the accompanying drawings.

Figure 1:
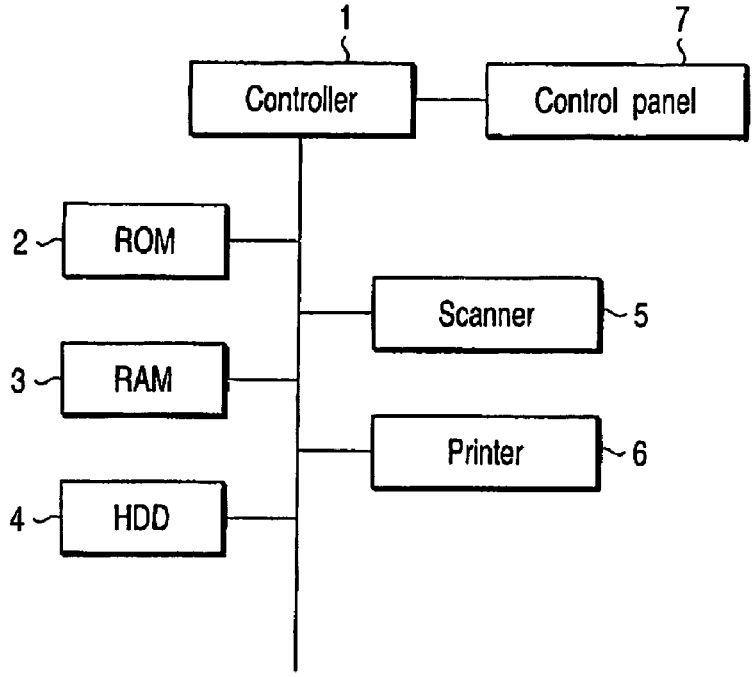
FIG. 1 is a block diagram schematically showing the configuration of an image forming apparatus according to the present invention, that is, a digital multi-function printer (MFP)

FIG. 1 is a block diagram schematically showing the configuration of an image forming apparatus according to the present invention, that is, digital multi-function printer (MFP). The image forming apparatus comprises controller 1, ROM 2 stored with control programs, RAM 3 storing data, hard disk drive (HDD) 4, scanner 5, printer 6 and control panel 7. The controller 1 controls the entirety of the apparatus. The HDD 4 stores various databases. The scanner 5 scans (reads) a document image. The printer 6 outputs an image based on image data. The control panel 7 makes various settings.

Figure 2:
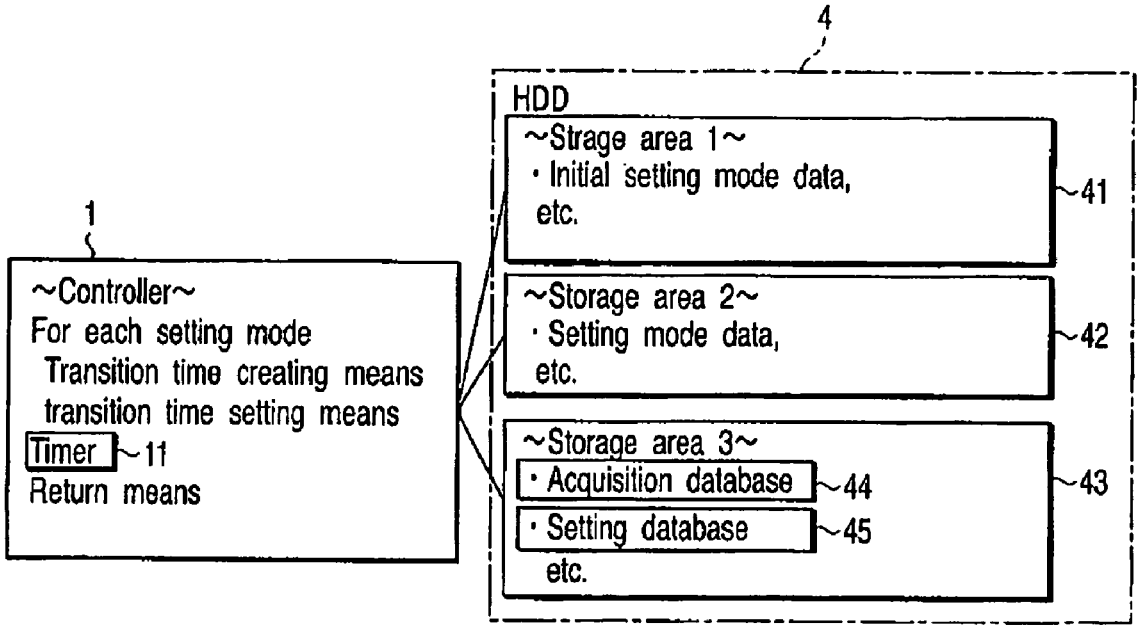
FIG. 2 is a view to explain the configuration of a controller and HDD.

FIG. 2 is a view to explain each configuration of the controller 1 and the HDD 4.

The controller 1 has transition time creating means, transition time setting means, timer 11 as clock means and return means for each setting mode.

The HDD 4 has areas 41 to 43 as storages 1 to 3. The area 41 stores initial setting mode data. The area 42 stores setting mode data. The area 43 stores acquisition database 44 and setting database 45.

The present invention having the foregoing configuration will be explained below.

According to the present invention, transition time is calculated and determined for each day of the week and for each time zone. Specifically, an auto transition time setting system calculates and determines the transition time in setting modes (auto power saving, auto off, auto clear, weekly timer) using the timer 11 in accordance with the frequency of using the image formatting apparatus. The determined transition time is set from a setting mode setup screen using the timer 11 of the image formatting apparatus.

The auto power saving is a function of changing the mode into an auto power saving mode if the image forming apparatus is not used within preset time. According to the auto power saving mode, the supply of power to unnecessary portions is stopped in a standby time.

The auto off is a function of automatically turning off power if the image forming apparatus is not used within preset time.

The auto clear is a function of automatically returning to initial setting and displaying a basic screen when predetermined time elapses after copy ends or the final key operation is made even if a reset key is not pressed.

The weekly timer is a function of automatically turning on/off the power of the image forming apparatus at desired setting time. For example, the timer is set to the start and finishing time of work, and thereby, the image forming apparatus is automatically powered on/off at the setting time.

User has manually preset the foregoing various settings such as auto power saving, auto off, auto clear and weekly timer.

However, if the foregoing setting is not proper, power is wastefully consumed, and there is a disadvantage of disturbing service for user. In other words, if transition time to the setting is late with respect to the services for user, wasteful power consumption increases. Conversely, if transition time to the setting is early, there is a problem that the services for user are disturbed.

According to the present invention, various setting modes manually set by user are automatically and properly set.

Figure 3:
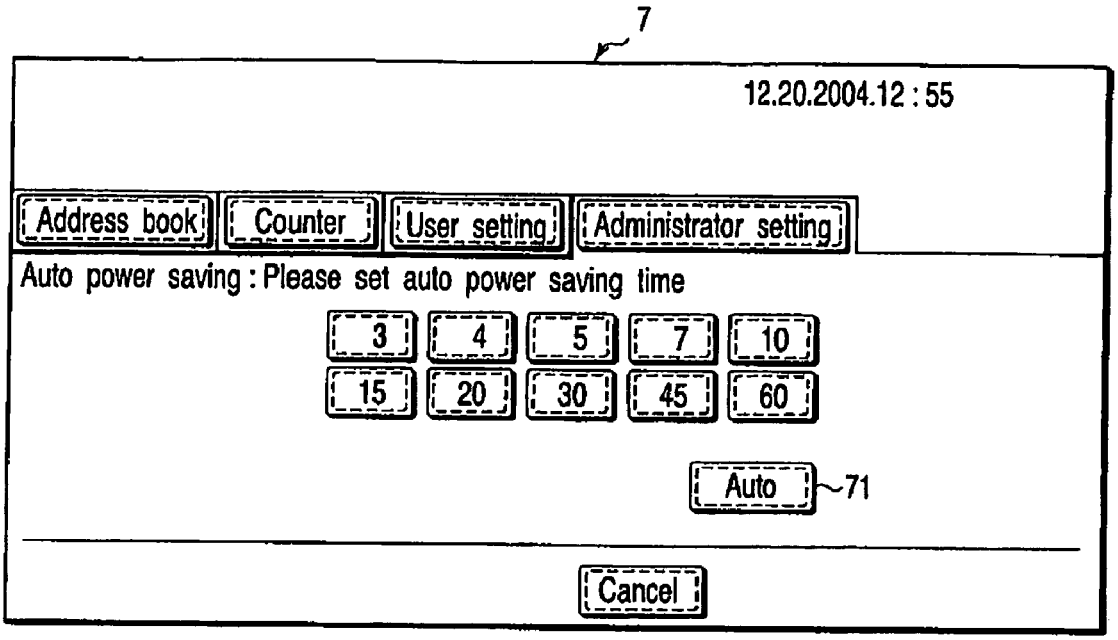
FIG. 3 is a view showing a transition time select screen displayed on a display unit in a control panel.

FIG. 3 is a view showing a transition time select screen displayed on a display unit in a control panel 7. An auto key 71 is pressed, and thereby, an "auto transition time setting system" is set.

Figure 4:
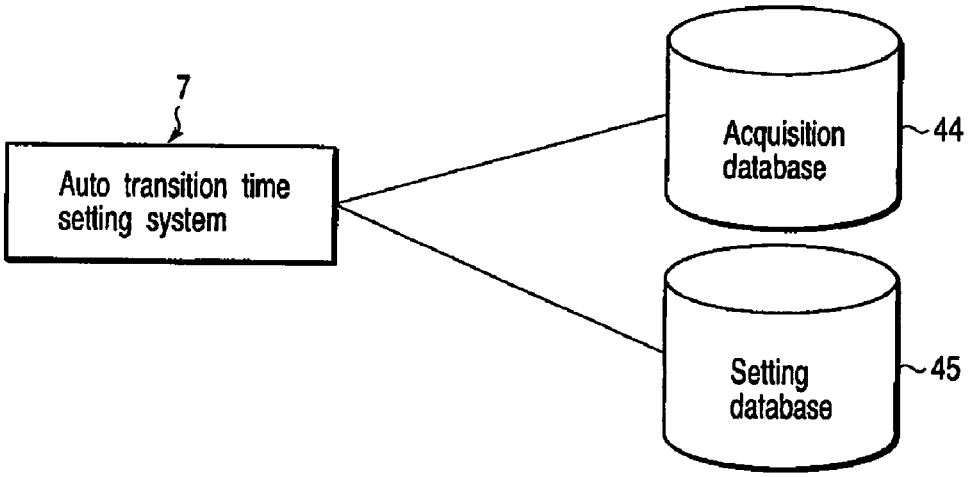
FIG. 4 is a view to explain the configuration of an auto transition time system.

FIG. 4 is a view to explain the configuration of the auto transition time setting system. When the auto transition time setting system is set in the controller 1, acquisition database 44 and setting database 45 stored in the HDD 4 are used.

Figure 5:
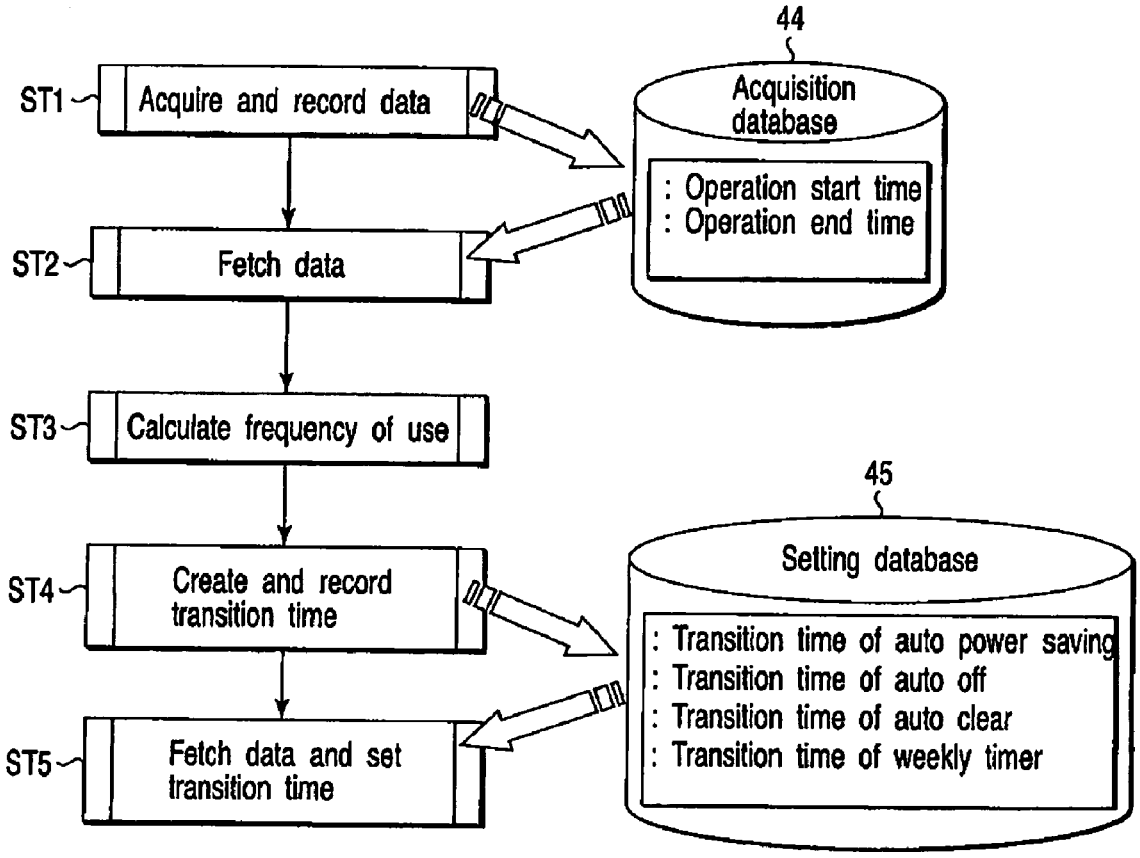
FIG. 5 is a flowchart to explain the entire operation of an auto transition time setting system.

With the foregoing configuration, the entire operation of the auto transition time setting system will be explained below with reference to a flowchart of FIG. 5.

The controller 1 acquires data such as operation start time and operation end time of the image forming apparatus, and then, records it in the acquisition database 44 (ST 1).

The controller 1 fetches the data recorded in the acquisition database 44 (ST 2) to calculate the frequency of use (ST 3).

The controller 1 creates each transition time of the foregoing auto power saving, auto off, auto clear and weekly timer, and thereafter, records it in the setting database 45 (ST 4).

The controller 1 fetches recorded data from the setting database 45 to set each transition time of the image forming apparatus (ST 5).

Figure 6:
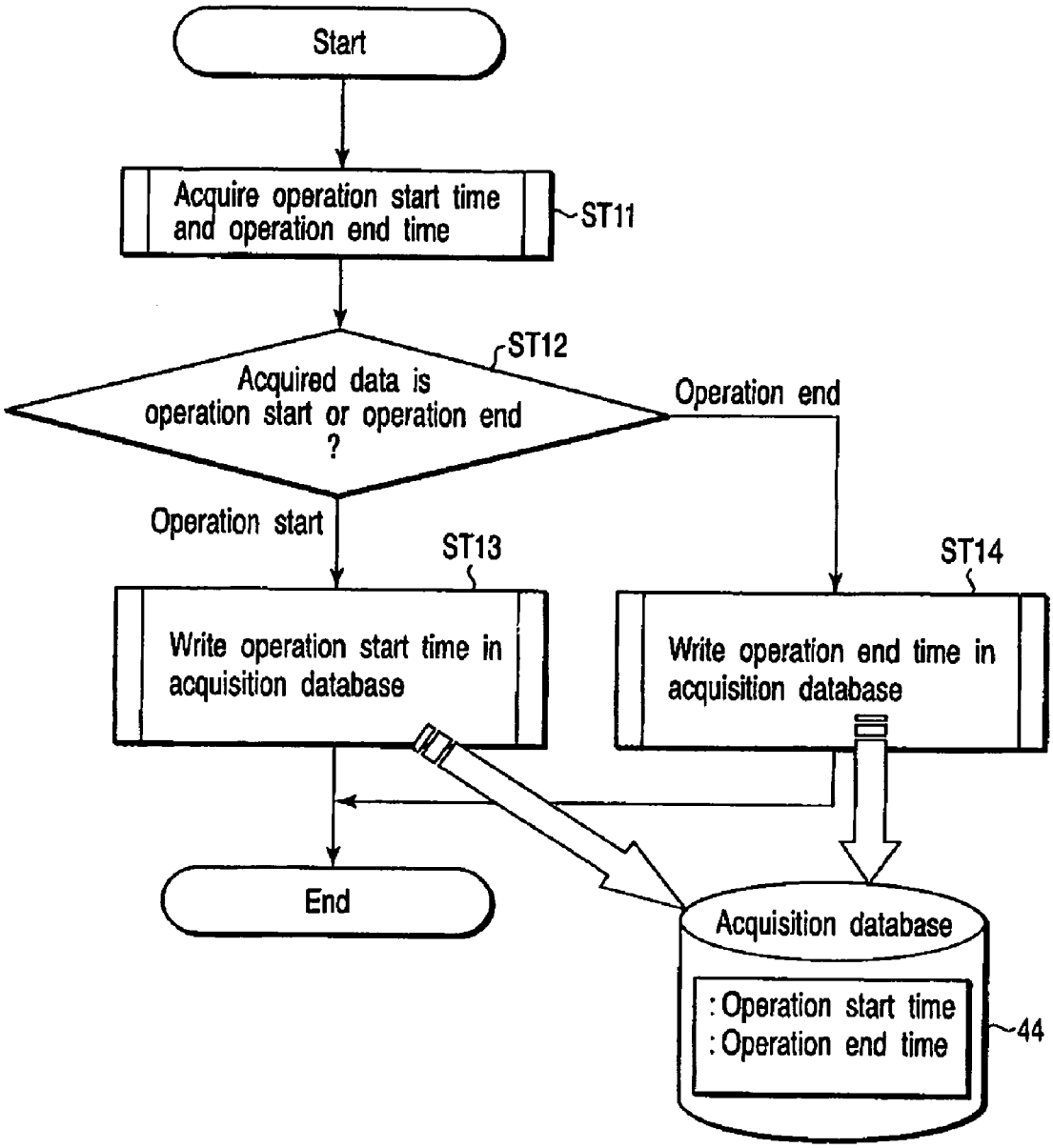
FIG. 6 is a flowchart to explain the operation of acquiring and recording data.

The operation of acquiring and recording data in the foregoing step ST 1 will be explained below with reference to a flowchart of FIG. 6.

The controller 1 acquires data such as operation start time and operation end time of the image forming apparatus (ST 11).

The controller 1 confirms which the acquired data is operation start or operation end (ST 12). If the acquired data is operation start, the controller 1 writes the operation start time in the acquisition database 44 (ST 13). On the other hand, if the acquired data is operation end, the controller 1 writes the operation end time in the acquisition database 44 (ST 14).

Figure 7:
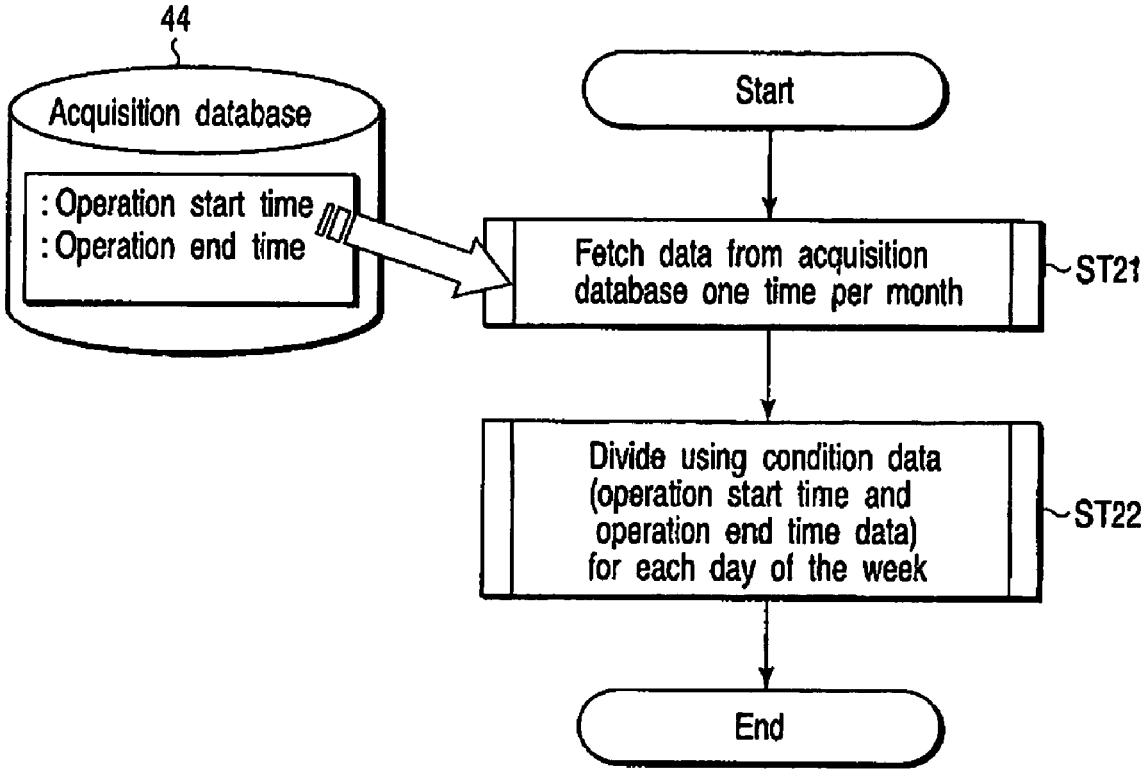
FIG. 7 is a flowchart to explain the operation of fetching data.

The operation of fetching data in the foregoing step ST 2 will be explained below with reference to a flowchart of FIG. 7.

The controller 1 fetches data from the acquisition database 44 in a cycle, for example, one time per month (ST 21).

The controller 1 divides the fetched using condition data (operation start and end time data) for each day of the week (ST 22).

FIG. 8 is a chart showing the operation start time (S[n]) and the operation end time (E[n]) for each day of the week (Sunday to Saturday).

Figure 9:
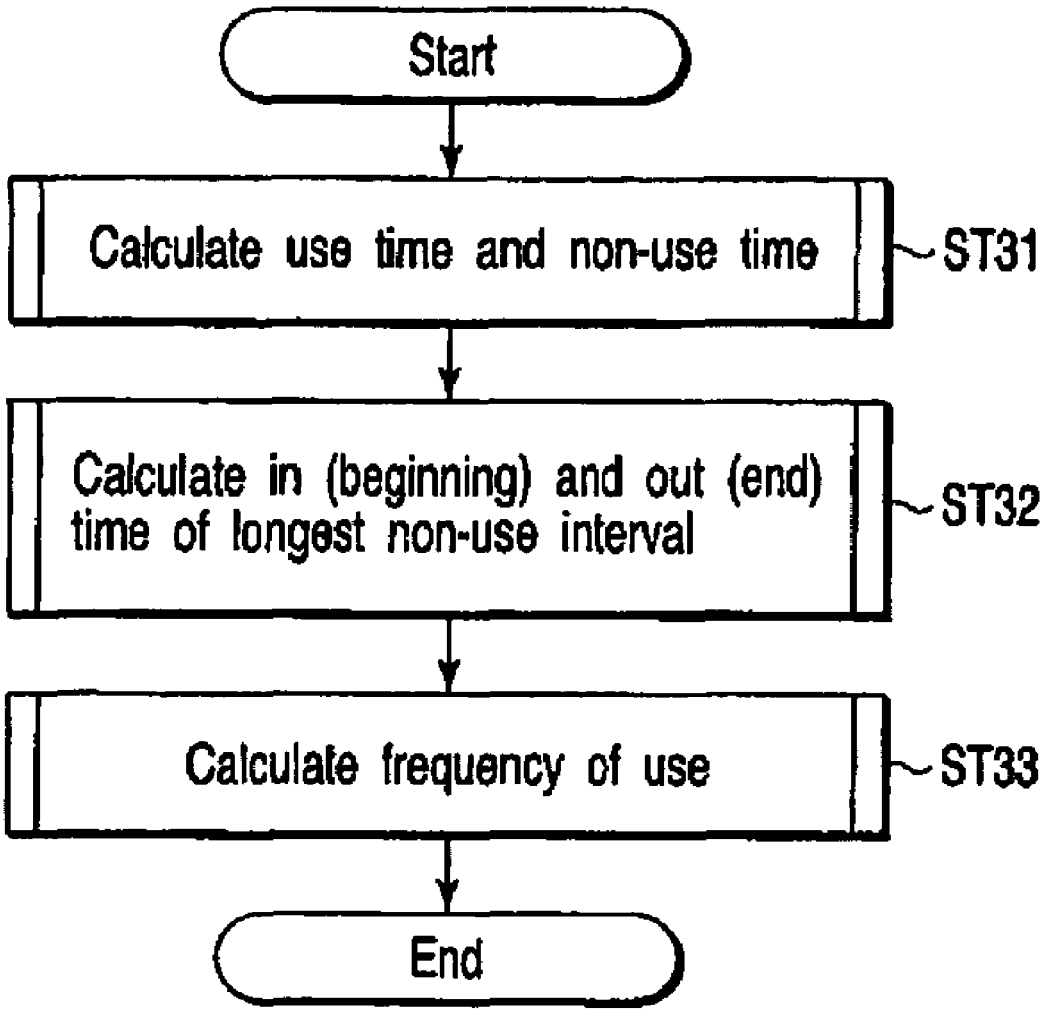
FIG. 9 is a flowchart to explain the operation of fetching data.

The operation of fetching data in the foregoing step ST 3 will be explained below with reference to a flowchart of FIG. 9.

The controller 1 calculates use time and non-use time (ST 31).

FIG. 10 is a chart showing total use time (TU[n]) and total non-use time (TI[n]) for each day of the week (Sunday to Saturday) and for each time zone.

The controller 1 calculates in (beginning) and out (end) time of the longest non-use interval for each day of the week (ST 32).

FIG. 11 is a chart showing in (I) and out (O) times of the longest non-use interval.

The controller 1 calculates the frequency of use (A[n]) for each day of the week (Sunday to Saturday) and for each time zone (ST 33). The frequency of use implies a ratio of use, and calculated using the following equation.

Ratio of use=total use time/(total use time+total non-use time)

FIG. 12 is a chart showing the frequency of use (A[n]) for each day of the week (Sunday to Saturday) and for each time zone.

Figure 13:
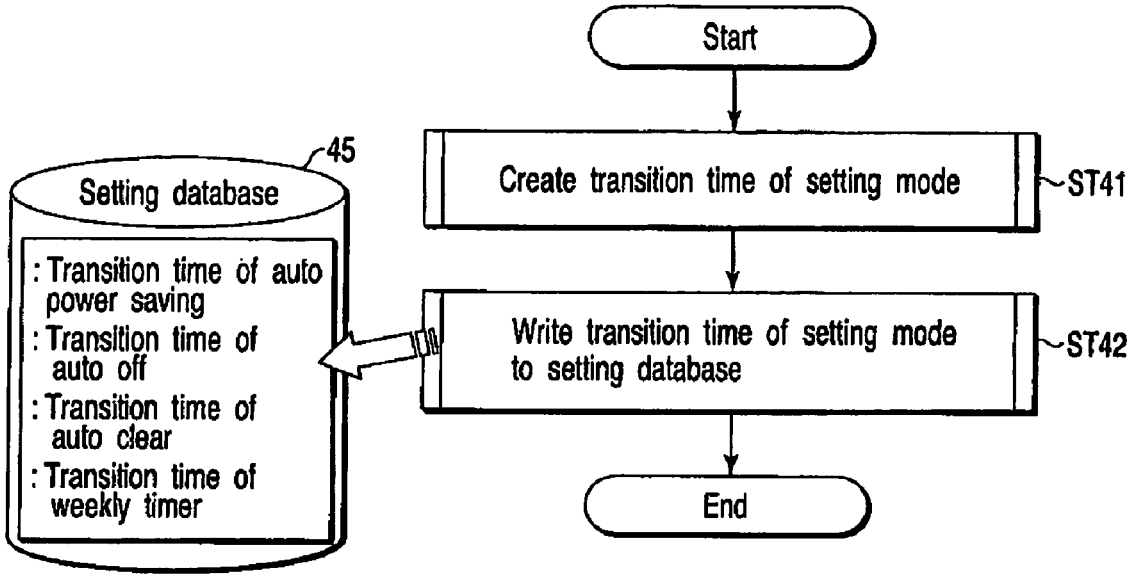
FIG. 13 is a flowchart to explain the operation of creating and recording transition time.

The operation of creating and recording the transition time in the foregoing step ST 4 will be explained below with reference to a flowchart of FIG. 13.

The controller 1 creates transition time of each setting mode for each day of the week and for each time zone using the timer 11 based on the frequency of use calculated in step ST 3 (ST 41). The setting mode includes auto power saving, auto off, auto clear and weekly timer using the timer 11.

For example, the transition time of auto clear is calculated based on the following equation for each day of the week and for each time zone.

Transition time (sec.)=187. 5×frequency of use

In this case, a transition time range is 15 to 150 seconds, and off time range has no limitation.

If 0≦transition time<15, 15 seconds is set

If 150<transition time≦187. 5, off is set

The transition time of auto power saving is calculated based on the following equation for each day of the week and for each time zone.

Transition time (minute)=60×frequency of use

In this case, a transition time range is 3 to 60 minutes, and if 0≦transition time<3, 3-minute is set.

The transition time of auto off is calculated based on the following equation for each day of the week and for each time zone.

Transition time (minute)=240×frequency of use

In this case, a transition time range is 3 to 240 minutes, and if 0≦transition time<3, 3-minute is set.

The transition time of weekly timer is calculated based on the following equations A and B for each day of the week and for each time zone.

Transition time (off)=average of "in" times of longest non-use interval A

Transition time (on)=average of "out" times of longest non-use interval B

The controller writes the foregoing transition time to the setting database 45 (ST 42).

FIG. 14 is a view showing a transition time data table (S[n]) for each setting mode written to the setting database 45.

Figure 15:
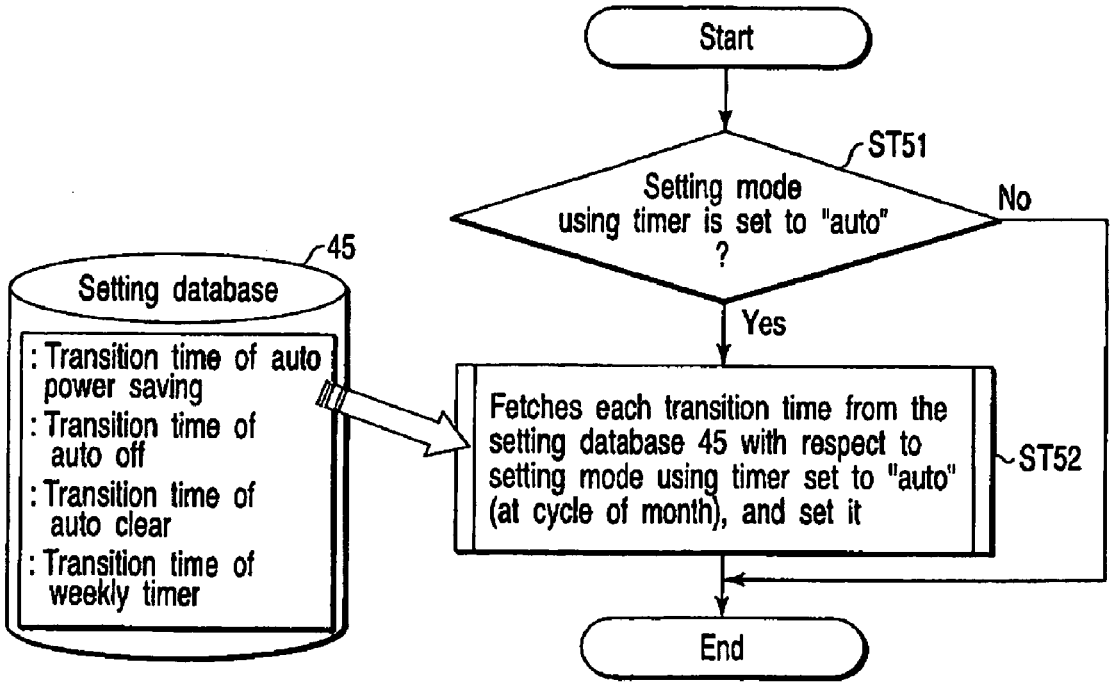
FIG. 15 is a flowchart to explain the operation of fetching data and setting transition time.

The operation of fetching data in the foregoing step ST 5 and setting transition time will be explained below with reference to a flowchart of FIG. 15.

The controller 1 confirms whether or not a setting mode using the timer 11 is set to "auto" (ST 51).

If "auto" is set, the controller 1 fetches each transition time from the setting database 45 with respect to setting mode using the timer 11 set to "auto" at a cycle of month, and sets it in the image forming apparatus (ST 52).

According to the embodiment of the present invention, in the actual operation of the image forming apparatus, transition time is calculated and set for each day of the week and for each time zone based on non-use time data of the apparatus. By doing so, the transition time is changed in accordance with use condition by user each day of the week and for each time zone. Therefore, it is possible to provide proper time setting without loss in accordance with the frequency of use by user.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus for reading an image of a document and forming an image of the read document, comprising:

a clock unit provided in the image forming apparatus, and clocking time;

a first recording unit acquiring and recording use data of the image forming apparatus;

a calculation unit fetching the use data recorded in the first recording unit, and calculating a frequency of use;

a second recording unit creating transition time of a setting mode based on the frequency of use calculated by the calculation unit, and recording it; and a controller controlling said setting mode of the image forming apparatus according to the transition time recorded in the second recording unit using the clock unit wherein the calculation unit calculates beginning and end times of the longest non-use interval of the image forming apparatus for each day of the week.

2. The image forming apparatus according to claim 1, wherein the use data recorded in the recording units are operation start time and operation end time of the image forming apparatus.

3. The image forming apparatus according to claim 1, wherein the calculation unit calculates time data of operation start and operation end for each day of the week.

4. The image forming apparatus according to claim 1, wherein the calculation unit calculates total use time and total non-use time of the image forming apparatus for each day of the week and for each time zone.

5. The image forming apparatus according to claim 1, wherein for each time zone, the calculation unit calculates a ratio of use=total use time/(total use time+total non-use time) for each day of the week and for each time zone to set a frequency of use.

6. The image forming apparatus according to claim 1, wherein the second recording unit is recorded with each transition time of auto power saving mode, auto off mode, auto clear mode and weekly timer mode for each day of the week and for each time zone as a setting mode.

7. The image forming apparatus according to claim 1, wherein the controller clocks transition time to an auto power saving mode using the clock unit with respect to the auto power saving mode of the setting modes, and sets the image forming apparatus to the auto power saving mode when the transition time of the auto power saving mode for each day of the week and for each time zone recorded in the second recording unit is given.

8. The image forming apparatus according to claim 1, wherein the controller clocks transition time to an auto off mode using the clock unit with respect to the auto off mode of the setting modes, and sets the image forming apparatus to the auto off mode when the transition time of the auto off mode for each day of the week and for each time zone recorded in the second recording unit is given.

9. The image forming apparatus according to claim 1, wherein the controller clocks transition time to an auto clear mode using the clock unit with respect to the auto clear mode of the setting modes, and sets the image forming apparatus to the auto clear mode when the transition time of the auto clear mode for each day of the week and for each time zone recorded in the second recording unit is given.

10. The image forming apparatus according to claim 1, wherein the controller controls the image forming apparatus according to a transition time of the weekly timer mode for each day of the week and for each time zone recorded in the second recording unit using the clock unit with respect to the weekly timer mode of the setting modes.

11. An image forming apparatus for reading an image of a document and forming an image of the read document, comprising:

clock means provided in the image forming apparatus, and for clocking time;

first recording means for acquiring and recording use data of the data of the image forming apparatus;

calculation means for fetching the use data recorded in the first recording unit, and calculating a frequency of use;

second recording means for creating transition time of a setting mode based on the frequency of use calculated by the calculation means, and recording it; and control means for controlling said setting mode of the image forming according to the transition time recorded in the second recording unit using the clock means wherein the calculation means calculates beginning and ending times of the longest non-use interval of the image forming apparatus for each day of the week.

12. The image forming apparatus according to claim 11, wherein the second recording means is recorded with a transition time of auto power saving mode, auto off mode, auto clear mode and weekly timer mode for each day of the week and for each time zone as a setting mode.

13. The image forming apparatus according to claim 11, wherein the control means clocks transition time to an auto power saving mode using the clock means with respect to the auto power saving mode of the setting modes, and sets the image forming apparatus to the auto power saving mode when the transition time of the auto power saving mode for each day of the week and for each time zone recorded in the second recording means is given.

14. The image forming apparatus according to claim 11, wherein the control means clocks transition time to an auto off mode using the clock means with respect to the auto off mode of the setting modes, and sets the image forming apparatus to the auto off mode when the transition time of the auto off mode for each day of the week and for each time zone recorded in the second recording means is given.

15. The image forming apparatus according to claim 11, wherein the control means clocks transition time to an auto clear mode using the clock means with respect to the auto clear mode of the setting modes, and sets the image forming apparatus to the auto clear mode when the transition time of the auto clear mode for each day of the week and for each time zone recorded in the second recording means is given.

16. A method of setting a setting mode of an image forming apparatus reading an image of a document and forming an image of the read document, comprising:

clocking time using clock means provided in the image forming apparatus;

acquiring and recording use data of the image forming apparatus;

fetching the recorded use data to calculate a frequency of use;

creating and recording each transition time of the setting mode based on the calculated frequency of use; and clocking and controlling each setting mode of the image forming apparatus according to the recorded transition time using the clock means wherein the clocking and controlling the setting mode of the image forming apparatus calculates beginning and ending times of the longest non-use interval of the image forming apparatus for each day of the week.

17. The method of setting a setting mode of an image forming apparatus according to claim 16, wherein said clocking and controlling each setting mode includes clocking transition time to an auto power saving mode using the clock unit with respect to the auto power saving mode of the setting modes, and setting the image forming apparatus to the auto power saving mode when the transition time of the auto power saving mode for each day of the week and for each time zone.

18. The method of setting a setting mode of an image forming apparatus according to claim 16, wherein said clocking and controlling each setting mode includes clocking transition time to an auto off mode using the clock unit with respect to the auto off mode of the setting modes, and setting the image forming apparatus to the auto off mode when the transition time of the auto off mode for each day of the week and for each time zone.

19. The method of setting a setting mode of an image forming apparatus according to claim 16, wherein said clocking and controlling each setting mode includes clocking transition time to an auto clear mode using the clock unit with respect to the auto clear mode of the setting modes, and setting the image forming apparatus to the auto clear mode when the transition time of the auto clear mode for each day of the week and for each time zone.

20. The method of setting a setting mode of an image forming apparatus according to claim 16, wherein said clocking and controlling each setting mode includes controlling the image forming apparatus according to a transition time of the weekly timer mode for each day of the week and for each time zone recorded in the second recording unit using the clock unit with respect to the weekly timer mode of the setting modes.

* * * * *